US006076060A

United States Patent [19]

Lin et al.

[11] Patent Number: 6,076,060

[45] Date of Patent: Jun. 13, 2000

[54] COMPUTER METHOD AND APPARATUS FOR TRANSLATING TEXT TO SOUND

[75] Inventors: Ginger Chun-Che Lin, Northboro; Thomas Kopec, Amherst, both of Mass.

[73] Assignee: Compaq Computer Corporation, Houston, Tex.

[21] Appl. No.: 09/071,441

[22] Filed: May 1, 1998

[51] Int. Cl.[7] ..... G10L 13/00

[52] U.S. Cl. ..... 704/260; 704/258

[58] Field of Search ..... 704/258, 260, 704/269

[56] References Cited

U.S. PATENT DOCUMENTS

| | | | |
|---|---|---|---|
| 4,979,216 | 12/1990 | Malsheen et al. | 381/52 |
| 5,091,950 | 2/1992 | Ahmed | 704/260 |
| 5,157,759 | 10/1992 | Bachenko | 395/2 |
| 5,283,833 | 2/1994 | Church et al. | 704/260 |
| 5,384,893 | 1/1995 | Hutchins | 704/267 |
| 5,572,625 | 11/1996 | Raman et al. | 704/260 |
| 5,652,828 | 7/1997 | Silverman | 704/260 |
| 5,732,395 | 3/1998 | Silverman | 704/260 |
| 5,749,071 | 5/1998 | Silverman | 704/260 |
| 5,751,906 | 5/1998 | Silverman | 704/260 |
| 5,774,854 | 6/1998 | Sharman | 704/260 |
| 5,799,267 | 8/1998 | Siegel | 704/201 |
| 5,828,991 | 10/1998 | Skiena et al. | 704/9 |
| 5,832,428 | 11/1998 | Chow et al. | 704/254 |
| 5,832,435 | 11/1998 | Silverman | 704/260 |
| 5,890,117 | 3/1999 | Silverman | 704/260 |

OTHER PUBLICATIONS

Bachenko, J., et al., "A Parser for Real–Time Speech Synthesis of Conversational Texts," *Third Conference on Applied Natural Language Processing, Proceedings of the Conference*, pp. 25–32 (1992).

McGlashan, S., et al., "Dialogue Management for Telephone Information Systems," *Third Conference on Applied Natural Language Processing, Proceedings of the Conference*, pp. 245–246 (1992).

Zimmerman, J., "Giving Feeling to Speech," Byte, 17(4) : 168 (1992).

Carlson, R., et al., "Predicting Name Pronunciation for a Reverse Directory Service," *Eurospeech 89. European Conference on Speech Communication and Technology*, pp. 113–115 (1989).

Medina, D., "Humanizing Synthetic Speech," *Information Week*, p. 46 (Mar. 18, 1991).

Lazzaro, J.J., "even as We Speak," *Byte*, p. 165 (Apr. 1992).

Wolf, H.E., et al., "Text–Sprache–Umsetzung für Anwendungen bei automatischen Informations–und Transaktions–systemen (Text–to–Speech Conversion for Automatic Information Services and Order Systems)," *Informationstechnik it*, vol. 31, No. 5, pp. 334–341 (1989).

Bachenko, J., et al., "Prosodic Phrasing for Speech Synthesis of Written Telecommunications by the Deaf," IEEE Global Telecommunications Conference; GLOBECOM '91, 2:1391–5 (1991).

Fitzpatrick, E., et al., "Parsing for Prosody: What a Text–to–Speech System Needs from Syntax," *Proceedings of the Annual AI Systems in Goverment Conference*, p. 188–94 (1989).

Yiourgalis, N., et al., "Text to Speech System for Greek," 1991 conference on Acoustics, Speech and Signal Processing, 1:525–8 (1991).

Takahashi, J., et al., "Interactive Voice Technology Development for Telecommunications Applications," Speech Communication, 17:287–301 (1995).

*Primary Examiner*—Krista Zele
*Assistant Examiner*—Michael N. Opsasnick
*Attorney, Agent, or Firm*—Hamilton, Brook, Smith & Reynolds, P.C.

[57] ABSTRACT

A computer method and apparatus provide fast and efficient conversion (translation) of text to phonemes. The method and apparatus employ a plurality of rule sets, each formed of rules designed for specific portions of an input text string. A suffix rule set is used to match substrings from the end of an input text string to suffix rules. A prefix rule set is used to match substrings from the beginning of the input text to prefix rules. And an infix rule set is provided to match substrings taken from the middle of the input text or any remaining text not matched by either the suffix of prefix rules. Phonemic data is produced for any portion of the input text that matches a particular rule. The phonemic data may be used by a speech synthesizer to vocalize or read aloud the input text. Dictionary lookup of any portions of the input text string in conjunction with rule matching is also provided.

38 Claims, 7 Drawing Sheets

COMPUTER METHOD AND APPARATUS FOR TRANSLATING TEXT TO SOUND

BACKGROUND OF THE INVENTION

As the popularity of computer systems and computer use grows, new technologies and applications are being developed which make computers appear to act more like people than machines. One such area of technology is computer speech development and processing. Speech synthesis, the ability of a computer to "read" and "speak" text to a user, is a complex task requiring large amounts of computer processing power and intricate programming steps.

In known computer speech synthesis systems, various mechanisms have been developed to allow a computer to "speak" text that is input or stored within the computer. These systems convert text into speech signals which are electronically "spoken" or vocalized through a speaker.

Generally, current speech synthesis systems are formed of a dictionary, a search (or processing) engine, and a digital vocalizer. The dictionary serves as a look-up table. That is, the dictionary cross references the text or visual form of a character string (e.g., word or other unit) and the phonetic pronunciation of the character string/word. In linguistic terms, the visual form of a character string unit (e.g., word) is generally called a "grapheme" and the corresponding phonetic pronunciation is termed a "phoneme." The phonetic pronunciation or phoneme of a character string unit is indicated by symbols from a predetermined set of phonetic symbols. To date, there is little standardization of phoneme symbol sets and usage of the same in speech synthesizers.

The engine is the working or processing member that searches the dictionary for a character string unit (or combination thereof) matching the input text. In basic terms, the engine performs pattern matching between the sequence of characters in the input text and the sequence of characters in "words" (character string units) listed in the dictionary. Upon finding a match, the engine obtains from the dictionary entry (or combination of entries) of the matching word (or combination of words), the corresponding phonemes or combination of phonemes. To that end, the purpose of the engine is thought of as translating a grapheme (input text) to a corresponding phoneme (the corresponding symbols indicating pronunciation of the input text).

Typically the engine employs a binary search through the dictionary for the input text. The dictionary is loaded into the computer processor physical memory space (RAM) along with the speech synthesizer program. The memory footprint, i.e., the physical memory space in RAM needed while running the speech synthesizer program, thus must be large enough to hold the dictionary. Where the dictionary portion of today's speech synthesizers continue to grow in size, the memory footprint is problematic due to the limited available memory (RAM and ROM) in some/most applications.

Thus to further improve speech synthesizers, another design was developed. In that design, the dictionary is replaced by a rule set. Alternatively, the rule set is used in combination with the dictionary instead of completely substituting therefor. At any rate, the rule set may be represented as a group of statements in the form:

IF (condition)-then-(phonemic result).

Each such statement (or rule) determines the phoneme for a grapheme that matches the IF condition. Examples of rule-based speech synthesizers are DECtalk by Digital Equipment Corporation of Maynard, Mass. and TrueVoice by Centigram Communications of San Jose, Calif.

In a rule-based speech synthesis system, each rule of the rule set is considered with respect to the input text. Processing typically proceeds one word or unit at a time from the beginning to the end of the original text. Each word or input text unit is then processed in right to left fashion. If the rule conditions ("If-Condition" part of the rule) match any portion of the input text, then the engine determines that the rule applies. As such, the engine stores the corresponding phoneme data (i.e., phonemic result) from the rule in a buffer. The engine similarly processes each succeeding rule in the rule set against the input text (i.e., remainder parts thereof for which phoneme data is needed). After processing all the rules of the rule set, the buffer holds the phoneme data corresponding to the input text.

The resultant phoneme data from the buffer is then used by the digital vocalizer to electronically produce an audible characterization of the phonemes that have been strung together in the buffer. The digital vocalizer generates electrical sound signals for each phoneme together with appropriate pausing and emphasis based on relations and positions to other phonemes in the buffer.

The generated electrical sound signals are converted by a transducer (e.g., a loudspeaker) to sound waves that "speak" the input text. To the listening user, the computer system (i.e., speech synthesizer) appears to be "reading" or "speaking" the input text.

There are a limited number of phonemes for any particular language, such as English. The entire set of phonemes for a language generally represents each sound utterance that can be made when speaking words in that language. Character arrangements for words in a language, however, may exist in an almost infinite number of arrangements. Sometimes, as input text is scanned, certain arrangements of characters will not match any rule in the rule set. In this case, the dictionary is maintained of words and portions of words which do not fit or easily match rules within the rule set. The engine first consults the dictionary to lookup an appropriate phoneme representation for the input text or portion(s) thereof. From the subject dictionary entry, the phoneme or phonemes for that portion of the input text are placed into the buffer. If certain words/character strings do not match entries in the dictionary, then the speech synthesizer applies the rules to obtain a phonetic pronunciation for those words.

SUMMARY OF THE INVENTION

Problems exist in prior art speech synthesis techniques. For example, for each portion of input text, every rule in the entire rule set is considered. As such, some processing time is wasted by considering rules that are inappropriate to (incapable of matching) the input text.

Another problem with prior art speech synthesis systems exists due to the single direction, single scan approach used in the prior art. Problems arise with this approach when trying to correctly convert compound words or words with a concatenating prefix to their corresponding phonemes. In language vocabularies which contain words with many concatenating sub-words, such as the German language, scanning words in only one direction often results in portions of one sub-word being grouped with portions of another sub-word. Breaking sub-words or prefixes apart results in inaccurate and incorrect phonemic representations in the buffer, which in turn results in a mis-utterance or mis-pronunciation of the input text.

As an example of this problem, in a word such as "rollerblading," a typical prior art system would begin scanning from the right or end of the word, to the left or beginning of the word. Thus, starting from the end of the word, the suffix "ing" would be converted to a phonemic representation in the buffer, leaving "rollerblad". Then, "blad" would be converted, leaving "roller". Next, "ler" would be converted, leaving "rol". And finally, the remaining "rol" would be converted. Such a conversion process misses the more common substring "roll", because the right-to-left scan first processes "ler" and thus does not see the larger more common "roll" substring of characters in the given input text.

As will be explained, using a multiple direction scanning approach of this invention, word conversion more closely matches the way a word is actually parsed when spoken by a human being. That is, "rollerblading" would be parsed "roll" "er" "blad" "ing" by this invention, rather than "rol" "ler" "blad" "ing" as in the prior art. Thus, applicants have discovered that pronunciation rules are more likely to produce correct results when the rules are applied/matched on substrings that mimic the way a human splits the given text string (or lacking that, when the match has the largest possible length). Applicants accomplish this with a bidirectional scan which is much less likely to tear off part (i.e., parse in the middle) of a substring that could be used to perform a better match later.

In summary, prior art speech synthesis systems are inefficient due to large memory and processing requirements needed to consider every rule for each subject input text. These systems are also poor at deciphering the correct utterance and pronunciation of complex character strings/words due to their single pass, single direction scanning technique.

The present invention addresses the foregoing problems. In particular, the present invention provides a method and apparatus for more accurately generating phonemic data from input text. Instead of using a single rule set, the invention uses multiple rule sets, each tailored for addressing/processing a specific portion of a text string (e.g., word). Substrings are selected from various locations in the input text and are compared with the rules in the rule set corresponding to that location of the text. In the preferred embodiment, the multiple rule sets include a prefix rule set for processing beginning portions of input text, a suffix rule set for processing ending portions of input text and an infix rule set for processing intermediate portions of input text. By using multiple rule sets based on the location of text substrings, the present invention more accurately translates input text to its corresponding phoneme string/sequence.

Furthermore, substrings from the input text are scanned in more than one direction. In the preferred embodiment scanning is from left to right at the beginning portion of the input text and right to left at the ending portion of the input text. Both directions are used for scanning/processing intermediate portions of the input text. This bidirectional approach allows more possible combinations of characters from the input text to be matched with rules tailored for letter groups of specific word locations.

In accordance with another aspect of the present invention, the rules in a given rule set are arranged in order of length of text to which each rule applies. That is, the rule applying to the largest length of text is placed first in the rule set. The rule applying to the smallest length of text is placed last in the rule set, and so forth for rules applying to intermediary lengths of text. Where multiple rules apply to a same length of text, those rules are arranged in alphabetical order, as well as by length, of the text to which they apply. This ordering of rules within each rule set enables the present invention to apply only rules of appropriate subject length and thus more efficiently apply the rules to the input text. As a result, the present invention minimizes processing time.

Accordingly, the invention greatly improves the speed, accuracy and ability to convert complex words to phonemic data, and thus to speech.

Generally, the invention method comprises the steps of (I) receiving, either from a program or a user, input text; (ii) providing a plurality of rule sets (as described above); and (iii) applying the rule sets to the input text to translate to and provide corresponding phonemic data. In particular, one rule set is for processing one portion of the input text and different rule sets are for processing respective different portions of the input text; and each rule set has one or more rules for processing the respective portion of the input text. For each rule set, the method compares the input text with at least one of the rules of the rule set to produce a portion of the phonemic data corresponding to the respective portion of the input text. As a result, different rule sets produce different portions of the phonemic data. As such, words may be converted in selected portions, which provides the ability to accurately translate complicated letter arrangements of a word to phonemic data.

As noted above, the preferred embodiment employs a suffix rule set containing text to phonemic data rules for ending portions of input text, a prefix rule set containing text to phonemic data rules for beginning portions of the input text, and an infix rule set containing text to phonemic data rules for middle portions of the input text. Using these rule sets, the invention method iteratively compares the ending portions of the input text to suffix rules in the suffix rule set to produce the ending portions of phonemic data. That is, the suffix rules set is applied and, if need be, reapplied any number of times (rounds) to capture whatever number of concatenated ending portions (i.e., suffixes) exist in the given input text. Eventually, a "no hits" rule match occurs with the suffix rules set, and a first remainder text, excluding the ending portions (i.e., suffixes) of the input text, results from this first set of rounds of comparison.

The invention method next iteratively compares the first remainder text to prefix rules in the prefix rule set to produce beginning portions (i.e., prefixes) of the phonemic data based on beginning portions of the first remainder text. The prefix rule set is cycled through multiple times until a "no hit" occurs. From this set of rounds of rule set comparisons, the invention produces a second remainder text which excludes the beginning portions of the first remainder text.

Finally, the invention method compares the second remainder text to infix rules in the infix rule set to produce middle portions of the phonemic data based on middle portions of the input text (i.e., the second remainder text). The invention iterates through the infix rule set until there are no further parts (i.e., characters) of the input text to process. After the suffix, prefix and infix comparisons are completed, the invention method combines the beginning portions, the middle portions and the ending portions of the phonemic data to produce a phoneme code string which phonetically represents or characterizes the input text.

When performing comparisons in the preferred method, suffix rule comparisons begin at a rightmost portion of the input text and compare strings in a right to left direction against appropriate rules (e.g. according to subject text length) of the suffix rule set. Prefix rule comparisons compare substrings in the first remainder text beginning at a leftmost portion and compare in a left to right direction against appropriate rules of the prefix rule set. Infix rule set comparisons compare second remainder text substrings beginning from rightmost and leftmost portions of the second remainder text and compare in a right to left and in a left to right direction, thus obtaining the middle portion of the phonemic data. By allowing substrings to be scanned from either end or the middle of the text, the invention allows words with long sets of concatenating prefixes or suffixes to be efficiently converted to desired phonemes.

A dictionary lookup process may also be provided which receives each of the incoming text, the first remainder text, and the second remainder text, and which attempts a dictionary lookup on each of these subject strings of text. The dictionary lookup process may then produce the phoneme data for the incoming text if it matches an entry in the dictionary. In this manner, a dictionary of difficult words to rule process may be used by the invention at various processing stages to determine if the remaining text is best converted to phonemic data by the dictionary process instead of (or in combination with) the rule process.

The terms "suffix," "prefix" and "infix," with respect to rule sets and the invention in general, are not intended to be limited to the grammatical definitions of suffix, prefix and infix portions of words, as defined in the English language proper. As a fictitious example, in the invention, an ending substring from input text may match a suffix rule having a grapheme string such as "ation," which is actually a combination of the English language suffix "ion" and a root word portion "at" (e.g., vacation and correlation). Proper English grammar would not parse such words between the "ation" and the preceding consonant to identify word parts, in contrast to the present invention parsing of text strings.

Accordingly, in the invention, the term "suffix" is not limited to its strict grammatical language definition, and likewise for the term "prefix." Rather, in this invention, a suffix is defined as any string of characters obtained from the end of a subject input text, and a prefix is defined as a string of characters obtained starting from the beginning of the input text. A suffix or prefix may end up being the whole input text itself. The "suffix," "prefix" and "infix" terminology, with respect to the rule sets, is merely illustrative of substring locations in the input text to which the rules of a rule set apply. Suffix rule sets match strings from the end of a word, prefix rule sets match strings from the beginning of words, and infix rule sets generally have rules matching strings occurring in the middle of words.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout different views. The drawings are not meant to limit the invention to particular mechanisms for carrying out the invention in practice, but rather, are illustrative of certain ways of performing the invention. Others will be readily apparent to those skilled in the art.

DETAILED DESCRIPTION OF THE INVENTION

Figure 1:
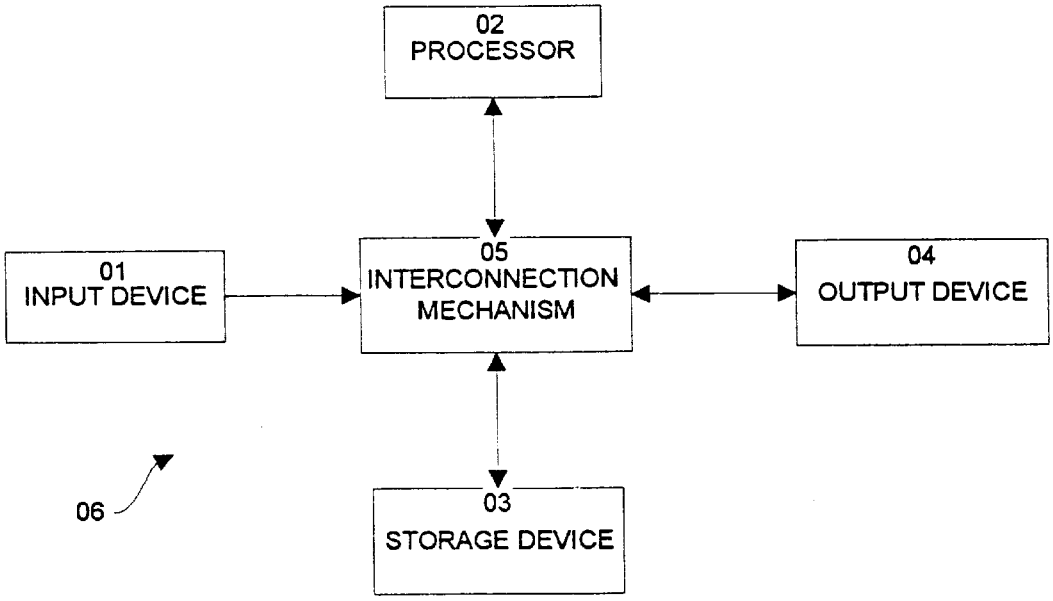
FIG. 1 is an illustration of a computer data processing system with which the present invention may be implemented.

Generally the present invention provides (a) a speech synthesis system employing a letter-to-sound rule processor, and (b) a method for efficiently converting text to phonemic data for use by a speech synthesizer. The invention may be implemented on a computer system such as that represented in FIG. 1. The computer system 06 shown in FIG. 1 illustrates the generic components 01 through 05 of most general purpose computers. The computer system 06 comprises an interconnection mechanism 05 such as a bus or circuitry which couples together an input device 01 such as a keyboard and/or mouse, a processor 02 such as a microprocessor, a storage device 03 such as a computer disk and an output device 04 such as a monitor, printer or speaker. There may be more than one of each component 01 through 05. Various parts of the invention will be described in conjunction with the components 01 through 05 of computer system 06. An example of such a computer system is an IBM Personal Computer or compatible or a network of such computers.

A high level overview of the general nature of the invention will first be presented to assist the reader in understanding more detailed embodiments and concepts discussed later. Generally, the invention speech synthesizer system receives text input (via input device 01) or stored in some fashion (e.g. storage device 03) within a computer system 06. As executed by processor 02, the speech synthesizer converts this text into phonemic data using a plurality of rule sets, in a very fast and efficient manner. The rule sets are stored in a processor or memory or in another accessible form. The phonemic data results in an audible characterization of the subject text as rendered through an appropriate output device 04 (e.g. a speaker).

Figure 2:
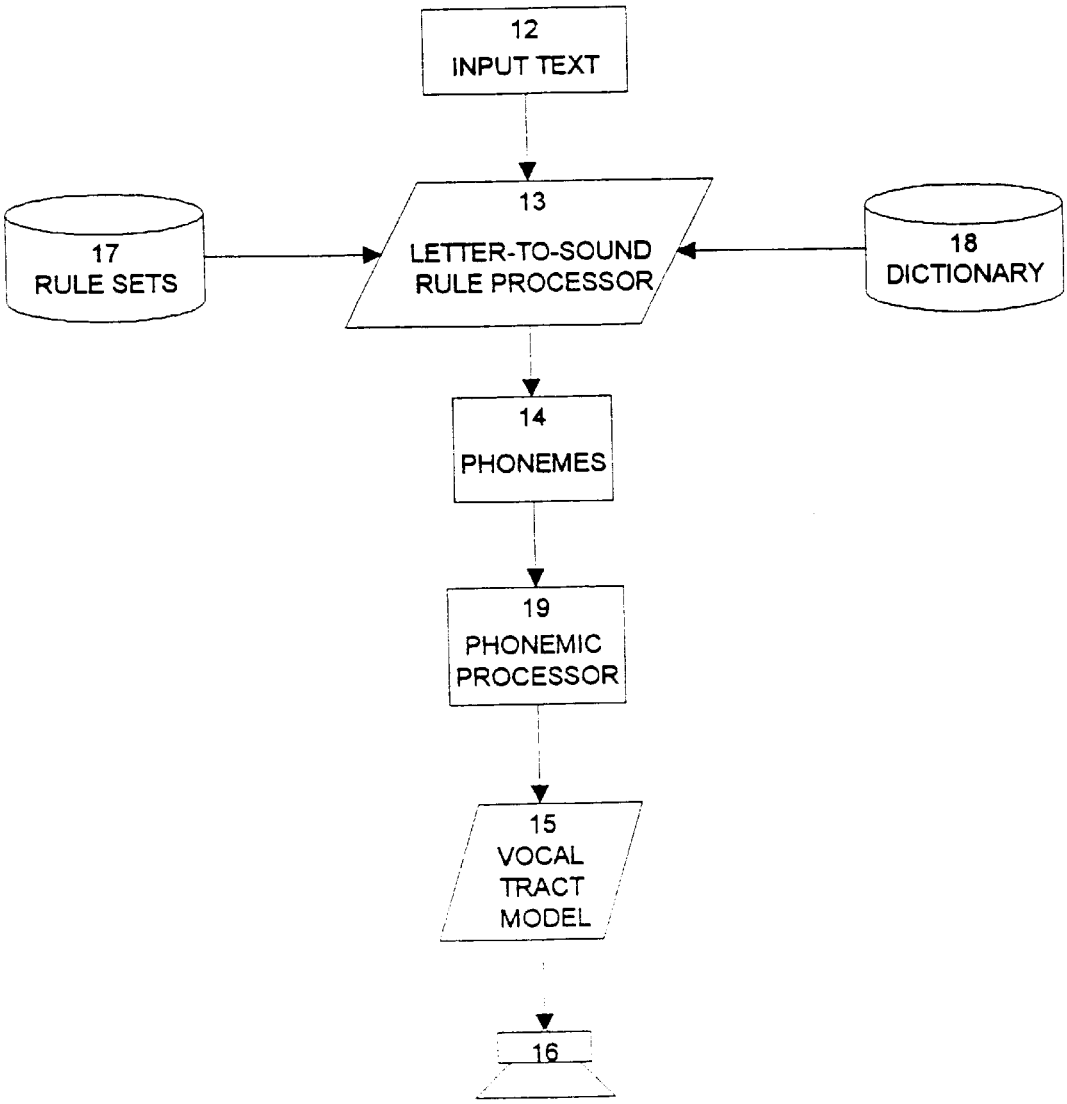
FIG. 2 is a schematic overview of a speech synthesizer system according to the present invention.

FIG. 2 illustrates the general flow of data and processing performed by a speech synthesizer according to the present invention. In FIG. 2, input text 12 is provided by a source to a letter-to-sound processor (LTS) 13. The source may be a software routine/program (e.g. interactive user interface) or a preprocessor or the like. One such preprocessor is described in the U.S. patent application entitled "RULES BASED PREPROCESSOR METHOD AND APPARATUS FOR A SPEECH SYNTHESIZER," cited above.

The LTS processor 13 converts or otherwise translates substrings or textstring units (e.g. words) in the input text 12 into corresponding phonemes 14 by consulting a plurality of rule sets 17 and a dictionary 18. As will be detailed below, to convert the input text 12 to its respective phonemes 14, the LTS processor 13 scans the input text 12 in plural passes and in more than one direction to apply the rules of the rules sets 17. The specific rule set and the direction used for processing a portion or substring of the input text 12 depends upon the location of the substring with respect to the input text 12 as a whole.

The resulting phonemes 14 produce a phonemic data sequence representing the pronunciation of the input text 12. A phonemic processor 19 receives as input the phonemic data/phonemes 14, and, after certain additional processing which is beyond the scope of the invention, produces a sequence of phonemic data for vocal tract model 15. The vocal tract model 15 converts the processed phonemic data sequence, along with added pauses (timing) and syllable emphasizing, into electrical signals which are sent to a speaker 16 for audible rendition or utterance of the subject text.

As mentioned above, LTS processor 13 processes portions of input text 12 in a manner depending on the location of the portion in the input text 12. In particular, LTS processor 13 employs (a) a suffix rule set to process ending portions of the input text 12, (b) a prefix rule set to process beginning portions of the input text 12, and (c) an infix rule set to process intermediate portions of the input text 12. Furthermore, LTS processor 13 scans ending portions of input text 12, from right to left (i.e., end of text string toward beginning of string), and scans beginning portions of input text 12 from left to right. For middle portions of input text 12, LTS processor 13 scans in both directions (right to left and left to right), preferably in parallel.

Accordingly, the suffix rule set contains a multiplicity of rules that map a respective suffix-like (ending) text string to its corresponding phoneme. In a preferred embodiment, each rule specifies (I) the grapheme string portion (i.e., written representation) of the subject text string, (ii) an indication of under which conditions the rule applies (e.g., qualifying surrounding environment of the subject text string), and (iii) the corresponding phonemic data, which may also be referred to as a phoneme string. Within the rule set, the rules appear in order of length of the text string (i.e., grapheme string) to which the rule applies. Thus, the rule specifying the grapheme string of longest length is listed first in the rule set, the rule specifying the grapheme string of second longest length is listed next, and so forth. Secondarily, for rules specifying grapheme strings of the same length, these rules are additionally arranged in alphabetical order (or another appropriate predefined sort order) based on their grapheme strings (subject text string). Table 1 below is illustrative.

TABLE 1

EXAMPLE PORTION OF SUFFIX RULE SET

| | Grapheme String | Phonemic Data (Phoneme String) |
|---|---|---|
| Rule 1 | -able | %xbl |
| Rule 2 | -ings | %\|Gz |
| Rule 3 | -less | %l\|s |
| Rule 4 | -ment | %mxnt |
| Rule 5 | -ness | %n\|s |
| Rule 6 | -ship | %S\|p |
| Rule 7 | -dom | %dxm |
| Rule 8 | -ers | %Rz |
| Rule 9 | -ful | %fl |
| Rule 10 | -ify | %\|fA |

Table 1 illustrates an example portion of a suffix rule set for English text strings. Ten rules are shown, each for converting a respective ending text string listed under the column headed "grapheme string", to corresponding phonemic data listed under the column similarly headed. For example, Rule 9 is used to convert an ending text string (i.e., the suffix grapheme string) "ful" to phoneme string "%fl".

Rules 1 through 6 are for ending text strings (grapheme strings) that are each four characters long and thus precede rules 7 through 10 which apply to ending text strings/grapheme strings that are only three characters long. Within Rules 1 through 6, the rules appear in alphabetical order of respective grapheme strings. Rules 7 through 10 are similarly sorted amongst each other according to alphabetical order of their respective grapheme strings.

It is understood that an actual suffix rule set may be much larger than Table 1, and may also contain other information used for processing the subject ending text string/grapheme string.

The prefix rule set and infix rule set are similarly configured to that of the suffix rule set described above, except that they contain rules for processing beginning text strings and intermediate portions, respectively, of the input text 12. That is, the prefix rule set contains a multiplicity of rules that map a respective beginning text string to its corresponding phoneme string. The infix rule set contains a multiplicity of rules that map a respective text string commonly occurring in intermediate locations of input text, to its corresponding phoneme string. Within each rule set, the rules are sorted/arranged first in order of length of the text string (grapheme) to which the rule applies and second (for rules of same length grapheme strings) in alphabetical order of the subject graphemes. Each rule specifies grapheme, corresponding phoneme and qualifying conditions as described above for the suffix rule set.

The rules for the rule sets may be generated manually by a linguist for example, or may be automatically generated. One example of automatic generation of rules is completely described in the co-pending U.S. patent application entitled "AUTOMATIC GRAPHEME-TO-PHONEME RULE-SET GENERATION," assigned to the assignee of the present application, the entire contents of which are incorporated herein by reference. The rule sets produced and described in the disclosure of the above mentioned reference may be used as the rule sets in the present invention. The example rules shown in Table 1 above are shown as a simplified example only, and the invention is not limited to rules or rule sets structured as those in Table 1.

There are numerous advantages resulting from the aforementioned aspects of the invention. Since each rule set is specifically tailored for a different location in the input text (i.e., prefix, suffix or infix word portion), many more types of text strings (i.e., grapheme strings) having various concatenation and letter or character patterns may be matched with multiple rule sets. Accordingly, the dictionary may be substantially smaller in size, saving memory space since more words may be matched using the rule sets alone. The rules of a given rule set being organized by grapheme string length and alphabetically within a common length enable the present invention to economize on valuable processing time. Further still, multiple rule set matching and multi-directional scanning provide for more accurate translation than heretofore achieved.

Figure 3:
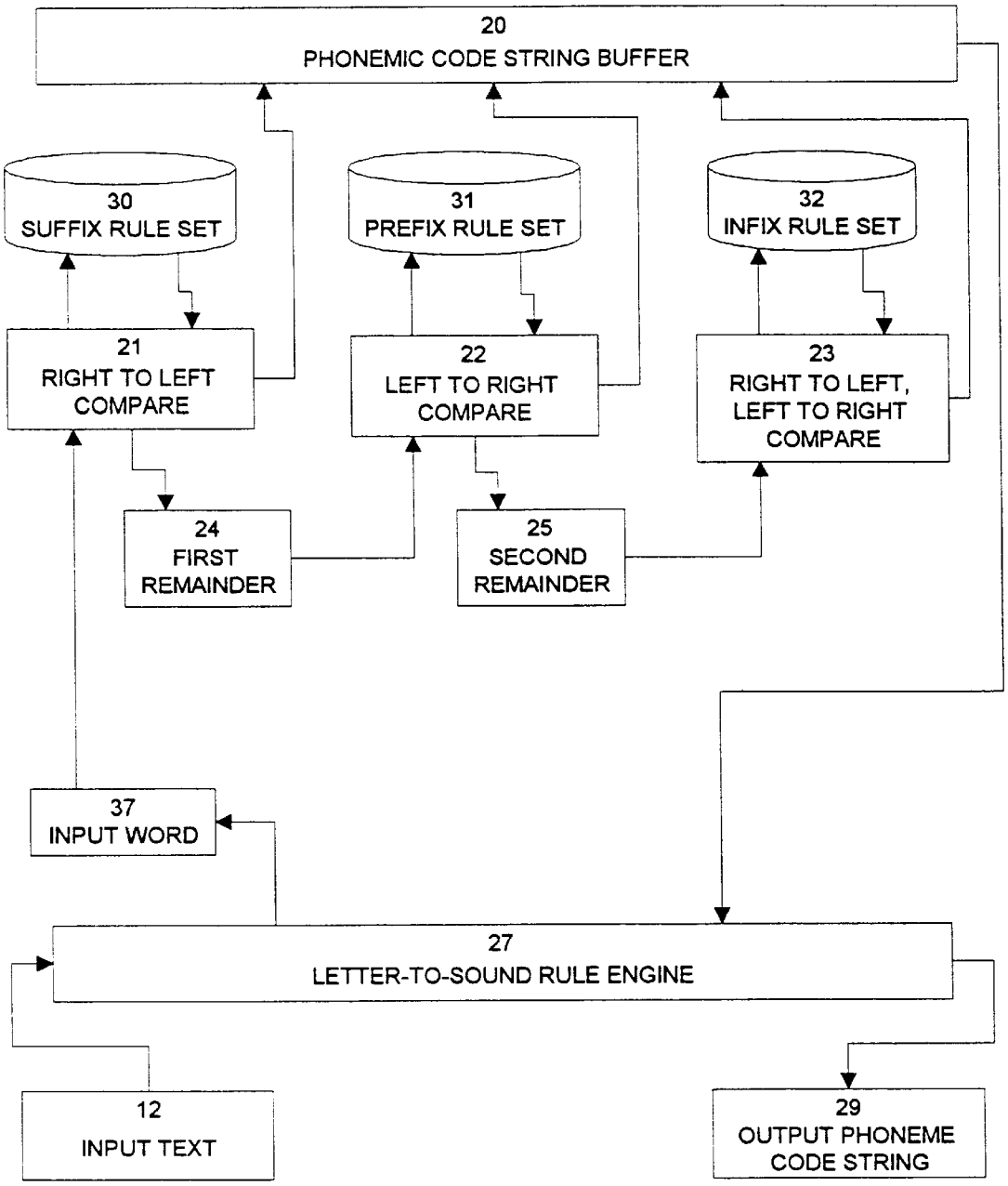
FIG. 3 illustrates data flow and processing components of one embodiment of the letter-to-sound processor of the invention which uses rule processing to translate input text to phonemic data.

FIG. 3 shows the details of a letter-to-sound (LTS) processor, such as the LTS processor 13 of FIG. 2, for example, according to one embodiment of the present invention. As noted previously, one general objective of the invention LTS processor 13 within a speech synthesizer is to create phonemic data in a buffer which represents the pronunciation of the input text to be "spoken" by the speech synthesizer. In FIG. 3, input text 12 is received by a letter-to-sound rule engine (LTS rule engine) 27. The LTS rule engine 27 controls the overall scanning process for individual text string units (e.g., words) within the input text 12. Upon detection of a pause or unit boundary, such as a space or a comma, the LTS rule engine 27 determines a single text string unit or input word 37 to exist in the input text 12. The LTS rule engine 27 passes the determined input word 37 to the right-to-left compare function 21, which begins scanning the input word 37 from right to left.

The right-to-left compare function 21 accesses the suffix rule set 30 for rules that map ending text strings (i.e., suffix grapheme strings) to corresponding phoneme strings. Suffix rule set 30 is configured as previously described above, in conjunction with Table 1. The primary objective of the right-to-left compare function 21 is to convert or translate any ending text string portions of input word 37 into corresponding phonemic data, and place this data into the phonemic code string buffer 20. Details of the operation of the right-to-left compare function 21 are shown by the flow chart in FIG. 6. It is important to note that the steps in FIG. 6 describe all three of the rule set compare functions of FIG. 3, i.e., the right-to-left compare function 21) the left-to-right compare function 22 and the right-to-left, left-to-right compare function 23, as will be explained in detail later.

In the compare processing of FIG. 6 (and hence right to left compare function 21 of FIG. 3), step 60 receives text as either an input word 37 (FIG. 3) or as remainder text (24, 25, or 26 as will be explained, also in FIG. 3). With respect to the processing of the right-to-left compare function 21 of FIG. 3, step 60 receives the input word 37. Step 61 then selects a rule from an appropriate rule set. The rule set (30, 31 or 32) accessed by step 61 of FIG. 6 depends upon which compare function, 21, 22 or 23 is being performed. In the instant discussion, the right-to-left compare function 21 accesses rules in the suffix rule set 30.

The initial rule selected from a subject rule set in step 61 is based upon the length of the text received in step 60. Step 61 selects the first rule in the rule set which has a grapheme string that is no longer than the text received in step 60. The general purpose of step 61 is to eliminate rule comparison processing for rules whose grapheme strings are longer than the subject text itself. For instance, if the text is the word "cat", there is no need to compare this text to rules in the rule set having grapheme strings that are four or more characters long. Thus, step 61 ensures that the subject text will only be compared with rule grapheme strings of equal or shorter length.

After step 61 has selected a rule from the rule set, step 62 selects a substring from the text. In step 62, the substring selected is equal in length (number of characters/graphemes) to the grapheme string portion of the rule selected in step 61. The substring is selected from a position/location in the text that depends upon which compare function, 21, 22 or 23 in FIG. 3, is being processed by steps 60–69 of FIG. 6. With respect to the right-to-left compare function 21, which uses suffix rule set 30, the substring is selected from the end of the text in step 62 scanning from right to left. When the processing steps of FIG. 6 are being executed for the left-to-right compare function 22, prefix rules are used from prefix rule set 31, and the substring is selected from the beginning of the text in step 62 scanning from left to right. When processing steps of FIG. 6 are being executed for compare function 23, infix rules are used from infix rule set 32, and the substring is selected from remaining portions of text scanning from both ends of that text.

Next, step 63 compares the substring selected from the text in step 62 to the grapheme string of the rule selected in step 61. In step 63, if the substring from the text matches the grapheme string from the rule, then step 66 enters the phonemic data from the rule into the phonemic code string buffer 20. Step 67 then removes the substring from the text selected in step 62. Step 68 then determines if there is any text remaining after the substring removal. If text still remains, step 68 passes control back to step 61, along with the remaining text, at which point a new rule is selected, based on the shortened remainder text length.

Accordingly, in step 63, each time a text substring matches a grapheme string of a rule, the rule's phonemic data is saved in the buffer 20 (step 66), the substring is removed (step 67) from the text, and any remaining text is passed back (step 68) to step 61 for continued rule processing using the same rule set 30, 31 or 32. At each matching iteration through steps 63 and then steps 66–68, the text gets shorter and shorter. If there is no text remaining at step 68 after substring removal, processing passes to step 69. Step 69 outputs remainder text, if any, and processing completes for the compare function 21, 22, 23 steps 60–69 shown in FIG. 6.

Figure 6:
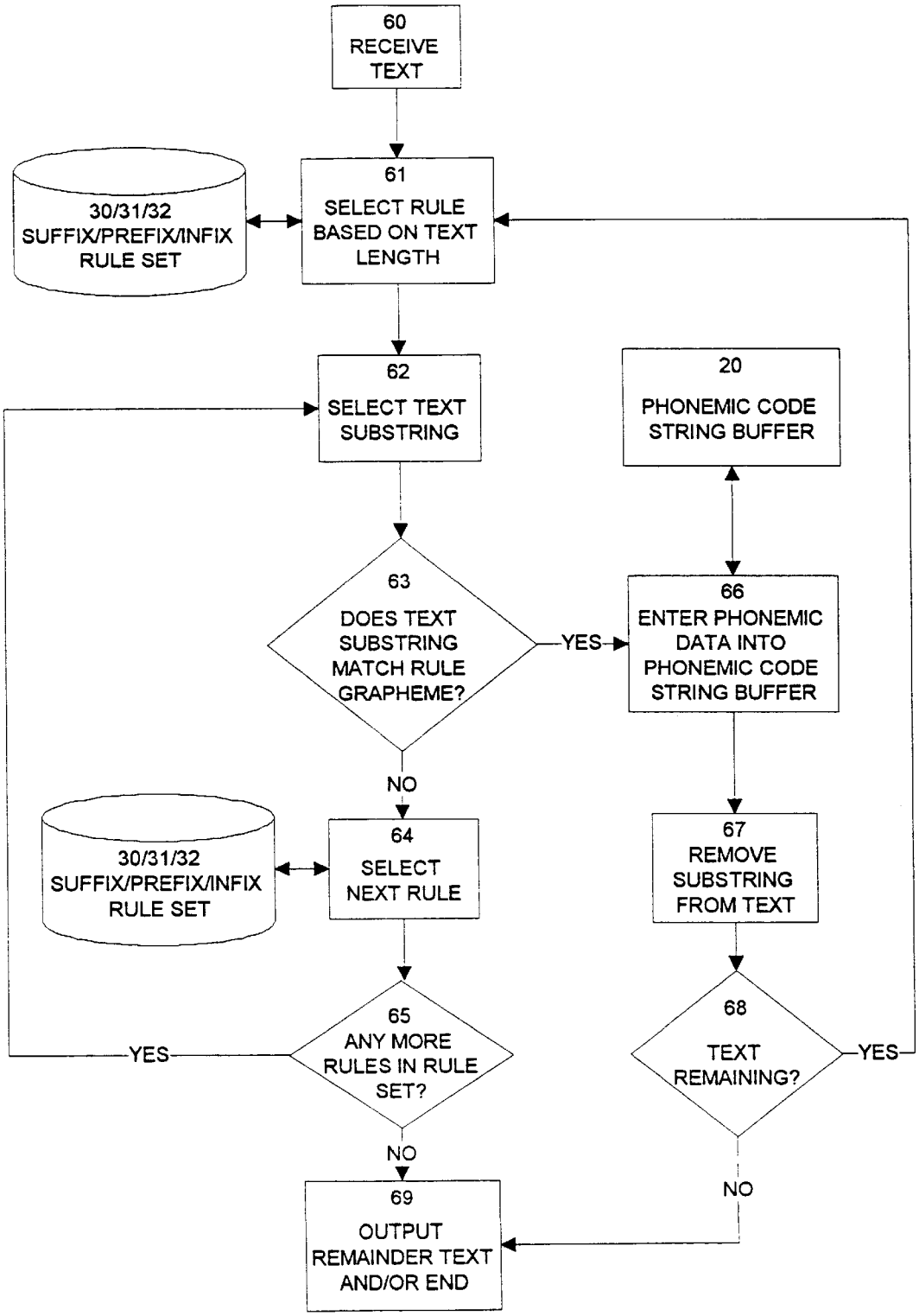
FIG. 6 is a flow chart of processing steps performed by compare functions of the invention in the FIG. 3, 4 and 5 embodiments.

In FIG. 6, step 63 may determine that the substring selected in step 62 does not match the grapheme string of the rule selected in step 61. In such a case, step 63 passes control to step 64, where the next rule in the subject rule set 30, 31 or 32 is selected. As noted above, depending upon which compare function (21, 22 or 23) is being processed by the steps shown in FIG. 6, the corresponding rule set (30, 31 or 32) is accessed for the next suffix, prefix or infix rule, respectively. In the case of the right-to-left compare function 21 of FIG. 3, the suffix rule set 30 is accessed by both steps 61 and 64 of FIG. 6. When step 64 selects another rule from the rule set, step 65 ensures there is a rule to be selected (i.e., that all appropriate rules of the rule set have not already been considered). Processing is passed back to step 62 to select a substring based on the grapheme string length of the rule selected in step 64. By returning to step 62, the new text substring, to be compared in step 63 to the grapheme string of the new rule selected in step 64, will be made the same length as the grapheme string of the new rule. Thus, if the new rule has a shorter grapheme string than the previous processed rule, step 62 shortens the text substring appropriately by scanning from a right (end of text substring) to left (beginning of substring) direction in the case of the right-to-left compare function 21 (and vice versa for the left-to-right compare function 22).

If step 64 attempts to select a rule, and there are no more rules in the subject rule set (30, 31 or 32), step 65 detects this condition and passes processing to step 69, which outputs any remainder text and ends compare function 21, 22, 23. In this case, every rule of applicable grapheme string length in a rule set will have been used in a comparison with a substring of the text, with no rule matching the most recently selected substring. During processing of the right-to-left compare function 21, with respect to FIG. 6, for example, suppose that only one substring from the text matches one rule in the suffix rule set 20. The remaining suffix rules are compared, one by one, with the next substring from the end of the text in the loop from steps 62–65, until the last suffix rule is reached. Step 65, detecting that no more suffix rules exist in the suffix rule set 21, exits the loop of steps 62–65. The leftover remaining text, including the most recently selected non-matching substring, is output in step 69 as the first remainder 24 in FIG. 3. That is, the remainder text output in step 69 for the right-to-left compare 21 is the input word 37 received at the beginning (step 60) of the compare function 21 absent any matched ending text substrings that matched suffix rules in suffix rule set 30.

According to the processing of the compare functions 21, 22 and 23, shown by the steps in FIG. 6 and described above for the right-to-left compare function 21, a text string is processed rule by rule until either no more rules in the rule set match substrings from the text, or until there is no more text to be processed. With respect to the right-to-left compare function 21 of FIG. 3, after processing of the right-to-left compare function 21 is complete, all of the ending text strings in the input word 37, matching grapheme strings of any suffix rules, are removed from the input word 37 and the corresponding phonemic data for these ending substrings are held in corresponding ending positions of the phonemic code string buffer 20.

It should be understood that as the processing of a compare function according to FIG. 6 proceeds, substrings of text are compared to each rule in the subject rule set 30, 31 or 32. Since the rule sets 30, 31 and 32 are arranged with the longest grapheme rules occurring first, step 61 initially serves the purpose of locating the first rule and its succeeding rules that have a grapheme string no longer than the starting text (from step 60) itself. Also, as a text substring is compared rule by rule in steps 63, 64 and 65, if the next rule selected has a shorter grapheme string than the previous rule used in a comparison, processing returns to step 62 which ensures that the text substring used in the comparison is of equal length to the grapheme string for that rule. Each time a match is found, the phonemic data is stored and the process repeats itself, beginning at step 61. By returning to step 61, the next rule selected will have the longest grapheme string in the rule set that is not longer than the remaining text. Advantageously, after each match in step 63, any text that remains after text substring removal in step 67 is again passed through the same rule set starting at the longest grapheme string rule applicable. This guarantees conversion of multiple concatenated text substrings of the same type (i.e., multiple suffixes, prefixes, or infix portions of text).

Returning to FIG. 3., the first remainder text 24 output from right-to-left compare 21 (step 69, FIG. 6) is received as input into the left-to-right compare function 22. The left-to-right compare function 22 is responsible for matching text substrings from the beginning of the first remainder text 24 to grapheme strings of prefix rules in the prefix rule set 31. The left-to-right compare function 22 of FIG. 3 performs the same general processing steps 60–69 as previously described and illustrated in FIG. 6 with respect to the right-to-left compare function 21. However, the left-to-right compare function 22 of FIG. 3 accesses the prefix rule set 31 in steps 61 and 64 of FIG. 6, instead of the suffix or infix rule sets 30, 32. Also, in step 62, substrings are obtained from the beginning of the text, scanning left-to-right, during processing of the left-to-right compare function 22, rather than the end of the text and scanning right-to-left. Other than those differences, the processing of the left-to-right compare function 22, with respect to the steps shown in FIG. 6, is generally the same as explained above.

During left-to-right compare function 22 processing as shown in FIG. 6, the first remainder text 24 is received as input text at step 60. Each text substring, obtained in step 62 from the beginning of the text, is compared, in step 63, against prefix rules from the prefix rule set 31. The phonemic data from matching prefix rules is entered, at step 66, into a corresponding beginning or leading position of the phonemic code string buffer 20. After the left-to-right compare function 22 has processed all of the prefix rules against the first remainder text 24, according to steps 60–69 of FIG. 6, any remaining text existing after substring removal is output as the second remainder text 25 in FIG. 3. Thus, the left-to-right compare function 22 processing converts all beginning text substrings that existed in the input word 37 into phonemic data. The second remainder text 25 only contains letters that did not match any grapheme strings in the suffix or prefix rules.

In FIG. 3, the second remainder text 25 is received as input into the right-to-left, left-to-right compare function 23. The right-to-left, left-to-right compare function 23 is responsible for matching all characters that exist in the second remainder text 25 to grapheme strings of infix rules from the infix rule set 32. The right-to-left, left-to-right compare function 23 also uses the processing steps of FIG. 6. However, during right-to-left, left-to-right compare function 23 processing, steps 61 and 64 in FIG. 6 access the infix rule set 32, instead of the suffix or prefix rule sets 30 and 31. Also, the right-to-left, left-to-right compare function 23 performs text substring/grapheme string rule comparisons from both ends of the subject text string (initially, second remainder text 25).

During right-to-left, left-to-right compare function 23 processing, in step 62 of FIG. 6, a separate substring is selected from each end of the subject text. Each text substring is equal in character length, where the length is based on the length of the grapheme string from the current rule selected from the infix rule set in step 61. Then step 63 determines if either substring selected matches the grapheme string for the selected infix rule. If one of the substrings matches the grapheme string of the rule, steps 66–68 are processed as previously described, and the phonemic data for that rule is entered into a corresponding intermediate or middle position of the phonemic code string buffer 20. In step 63, if neither substring matched the grapheme string for the selected rule, step 64 selects a new (succeeding) infix rule. Next step 65 loops back to step 62, where two substrings are again selected from each end of the text to ensure their proper length in relation to the new rule grapheme length.

An alternative aspect to selecting separate substrings from each end of the text is to begin selecting substrings from one end of the text, and continuing to select successive substrings embedded in the text, until the other end of the text is reached. However, according to this variation, suppose, for example, that the second remainder text 25 contained the fictitious text "abcde" and the first infix rule had a grapheme string three characters long. Thus, instead of selecting three characters from one end of the text and three characters from the other end, Step 62 in FIG. 6 begins at one end of the "abcde" text, such as at "a", and selects multiple three character strings, each offset by one character, until the other end of the text is reached. Step 62, in this example, would select substrings "abc", "bcd" and "cde". Each of these substrings is compared, in step 63, to the grapheme string for the selected infix rule. If any substring matches the rule's grapheme string, step 66 converts that substring in the text to the corresponding rule phonemic data. Step 67 removes the matching characters from the text. The process repeats on any remaining characters in the text. If the matching substring after removal in step 67 leaves two remainder strings that are split apart by removal of the matching substring in the middle, each is a leftover string in step 68 which is treated as a separate third remainder string. Thus each gets separately compared iteratively against the infix rule set by returning to step 61.

An alternative embodiment of the invention avoids the problem of splitting the second remainder string into multiple third remainders by removing an infix string from the middle of the second remainder. In this alternative embodiment, when selecting infix substrings to match against infix rules, step 62 is limited to only selecting substrings from the beginning or ending portions of the second remainder. Thus, if a match is found in step 63, the remaining third remainder will not be split into two third remainders, since the matching substring is selected only from the beginning or end, and not from the middle.

Another alternative embodiment also solves the problem of having multiple third remainders when selecting infix substrings. In this embodiment, when selecting infix substrings in step 62, the entire text is examined for the largest possible infix substrings that match infix rules. If a large infix substring is found nested in the text of the second remainder, it is delimited with markers. After marking off the largest nested infix substring, the remaining portion of the text to the left of the first marker (i.e., the beginning of the second remainder), and the remaining portion of the text to the right of the last marker (i.e., the ending portion of the second remainder) are treated as separate second remainders and are separately matched against the infix rule set. For each rule, remove any delimiter marks from the ends of the subject text. Test each end for a match; if found, convert to phonemic data of the rule and restart. If not found, scan the text for a match, and if found, mark the bounds of the embedded match to ensure that it will be intact after subsequent attempts to convert smaller substrings in the text. As a result, the marked off middle portion comprising the largest matched infix rule substring is actually converted to/processed for phonemic data after each end has been completed.

For example, if the second remainder is "abcdefgh", and the largest infix rule matching characters nested within this string is "cdefg", in step 62, when substrings are selected, this string is detected within the second remainder and is marked off by a set of delimiters, such as, for example, the character '|'. Thus, the delimited second remainder appears as "ab|cdefg|h". The process continues in a similar fashion with succeeding rules in the Infix rule set. Eventually, the rule for "ab" is applied and converts the "ab" on the left end. This leaves "|cdefg|h" as a next stage second remainder. Starting again at the top (beginning) of the Infix rule set, the leading delimiter mark "|" is removed leaving "cdefg|h". The large delimited infix substring "cdefg" is then matched with the rule to which is corresponds leaving "|h". Starting again at the top of the Infix rule set, the leading delimiter "|" is removed, leaving "h". Eventually, "h" is matched to a rule and converted.

Thus, by marking off and delimiting the largest nested infix substring first, before processing other substrings, the problem of having and tracking multiple split third remainders is avoided. Note also that the presence of a delimiter mark may be used to adjust the comparison on subsequent match attempts. That is, as the subject text is scanned and a delimiter mark is reached, it is as if the Infix rule processing is effectively restarted. The matching is stopped and all rules of a length greater than the distance from the delimiter mark to either end of the text are eliminated. In practical terms, this immediately eliminates many comparisons.

Accordingly, the right-to-left, left-to-right compare function 23 processing, shown generally by FIG. 6, uses infix rules that match grapheme strings to intermediate letter patterns that may occur anywhere in the middle of the subject text (e.g. input word 37). The middle of the subject text is defined as any characters remaining after suffix and prefix rule matching has taken place. Since the substring patterns may occur at any intermediate position in the subject text, substrings may be obtained from either both ends of the second remainder 25, or from each successive character position in the second remainder 25.

The infix rules in the infix rule set 32 may have grapheme strings as short as a single letter/grapheme. Thus, as more and more infix rules are compared and do not match substrings from either end of the text, or from any intermediate position, the infix rules occurring further down in the infix rule set 32 begin to have shorter and shorter grapheme strings (since the rules are ordered by grapheme string length). Eventually, after some substrings from the text are translated to phonemic data, there may be only one letter left in the remaining text at step 68 in FIG. 6. This single letter will eventually be matched against an infix rule having only that letter as its grapheme string (i.e., a single grapheme).

After completing the right-to-left, left-to-right compare function 23, all characters of the input word 37 will have been matched to rules in either the suffix, prefix, or infix rule sets 30, 31, 32 or a combination thereof. The input word 37 is represented by the resulting phonemic data in the phonemic code string buffer 20 as a phonemic data sequence. The LTS rule engine 27 detects the completion of the processing of the input word 37, and similarly processes incoming input words from the input text 12 in the manner described above.

In some cases, only compare functions 21 and 22, or just either one alone may be all that is needed to translate all characters of an input word 37 to phonemic data. In such cases, the LTS rule engine 27 is notified by the compare function (either 21, 22 or 23) that no text remains, and the LTS rule engine begins processing the next input word 37. Upon completion of compare functions 21, 22, 23 of each input word 37, the LTS rule engine 27 returns the contents of the phonemic code string buffer 20 as the output phoneme code string 29 containing the phonemic data sequence corresponding to the input text, as shown in FIG. 3. The LTS rule engine 27 may return the output phoneme code string 29 on a word by word basis, or may wait until all words in the entire input text 12 are converted to phonemic data before returning the output phoneme code string 29 as a phonemic data sequence.

In FIG. 3, the output phoneme code string 29 is effectively equivalent to phonemes 14 of FIG. 2, for example. The output phoneme code string 29 is subsequently processed (by phonemic processor 19) for eventual interpretation by the vocal tract model 15 of FIG. 2 to produce electronic signals sent to a speaker 16. In this manner, the invention performs speech synthesis on the input text 12 of FIG. 2.

The embodiment of FIG. 3 provides an efficient method and apparatus for converting text to phonemic data which may be "spoken" by a speech synthesizer according to the invention. The embodiment shown in FIG. 3 greatly enhances performance (increases accuracy) over prior art text-to-phonemic translators and speech synthesizers due, for example, to the use of multiple rule sets and the multiple direction comparison scanning approach. By having separate and rigorous prefix, suffix and infix rule sets, many dictionary lookups are made unnecessary and may be completely eliminated.

Figure 4:
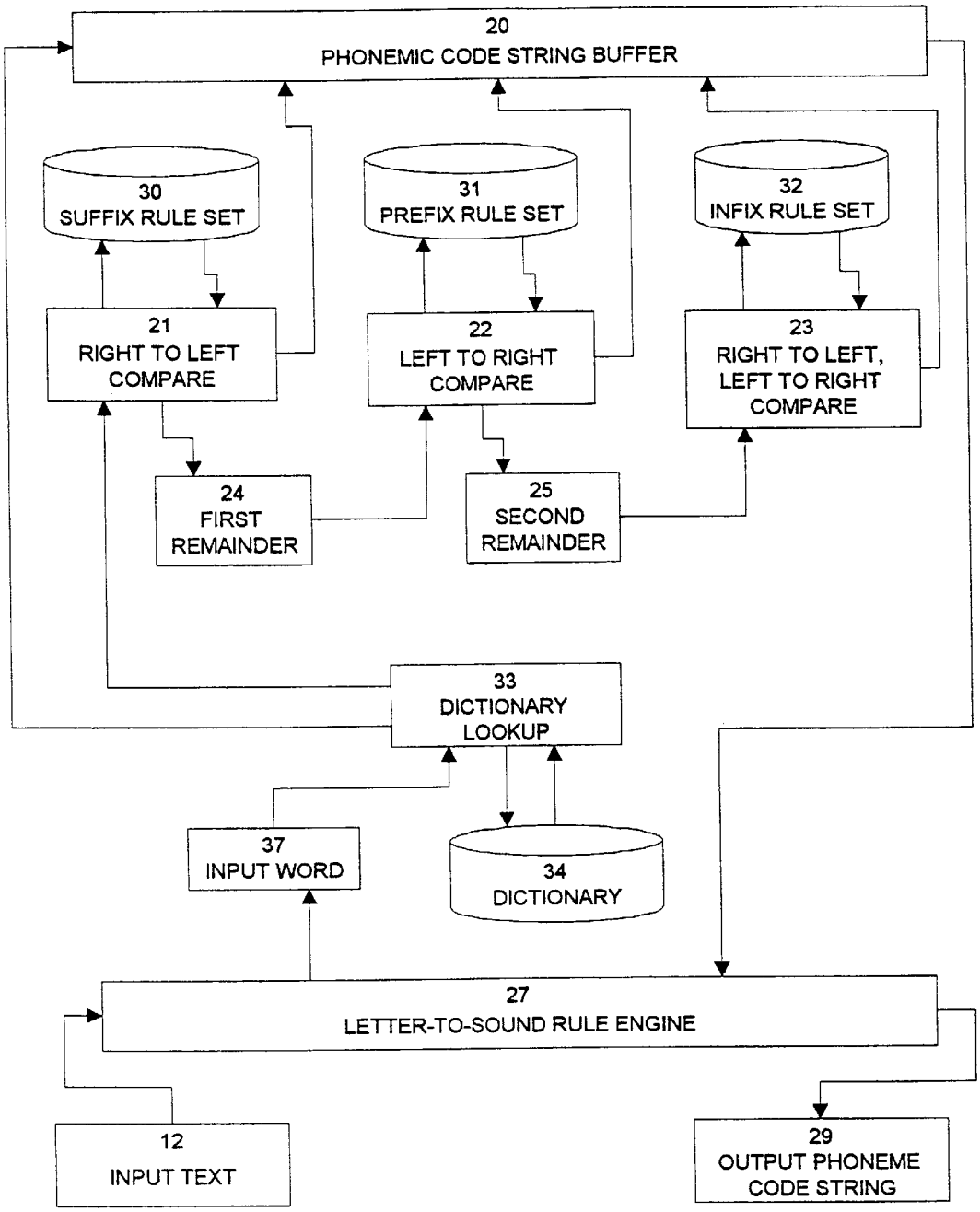
FIG. 4 illustrates data flow and processing components of another embodiment of the letter-to-sound processor which uses a dictionary lookup function before rule processing takes place.

FIG. 4 illustrates an alternative embodiment of the invention, which is similar to the embodiment of FIG. 3, but which also provides a dictionary lookup procedure. In certain languages, straight rule processing (as shown by the embodiment in FIG. 3) may be difficult to perform correctly or efficiently for certain words/text strings. The embodiment shown in FIG. 4 eliminates rule processing for certain difficult input words 37 which may exist in the input text 12. The rule processing functionality (compare functions 21–23) shown in FIG. 4 operates in the same manner as described with respect to FIG. 3. However, in FIG. 4, as the letter-to-sound rule engine 27 begins processing an input word 37 from the input text 12, the input word 37 is first compared against a dictionary 34 by the dictionary lookup function 33. If the input word 37 is found in the dictionary 34, rule processing via compare functions 21–23 is not performed for that input word 37. Instead, the phonemic data for the input word 37, located in the dictionary 34, is provided by the dictionary lookup function 33 to the phonemic code string buffer 20. The LTS rule engine 27 may then return the phonemic data as output phoneme code string 29, and may begin processing another input word 37 from the input text 12.

According to this embodiment, the dictionary 34 does not have to be a large dictionary of words, as in prior art speech synthesis systems. Rather, the dictionary 34 may be limited to a small number of entries corresponding to words within a particular language that are cumbersome to convert to phonemic data via the multiple rule set processing alone. Other working aspects of Dictionary 34 and dictionary look-up function 33 may be known in the art. Examples of such products are DECtalk by Digital Equipment Corporation, TrueVoice by Centigram Communications, and Lernout and Hauspie Text To Speech by Lernout and Hauspie, Inc. Other dictionary-type support systems are suitable.

In an alternative variation of the embodiment described above in relation to FIG. 4, the processing of dictionary lookup function 33 takes place in parallel with the processing being performed by the compare functions 21–23. If the dictionary lookup function 33, processing the input word 37 in parallel with one or more of the rule set compare functions 21–23, finds a match in the dictionary 34, the phonemic data for the input word 37 is passed to the LTS rule engine 27, which may in turn interrupt the compare functions already underway. The LTS rule engine 27 need not wait for rule processing to complete for an input word 37 that has been looked-up in dictionary 34. This variation of the embodiment shown in FIG. 4 allows one or more rule set comparison functions (21, 22, 23) to begin while the dictionary lookup function 33 is processing. The parallel processing nature of this embodiment further (speeds up the overall throughput) minimizes processing time of the invention.

Figure 5:
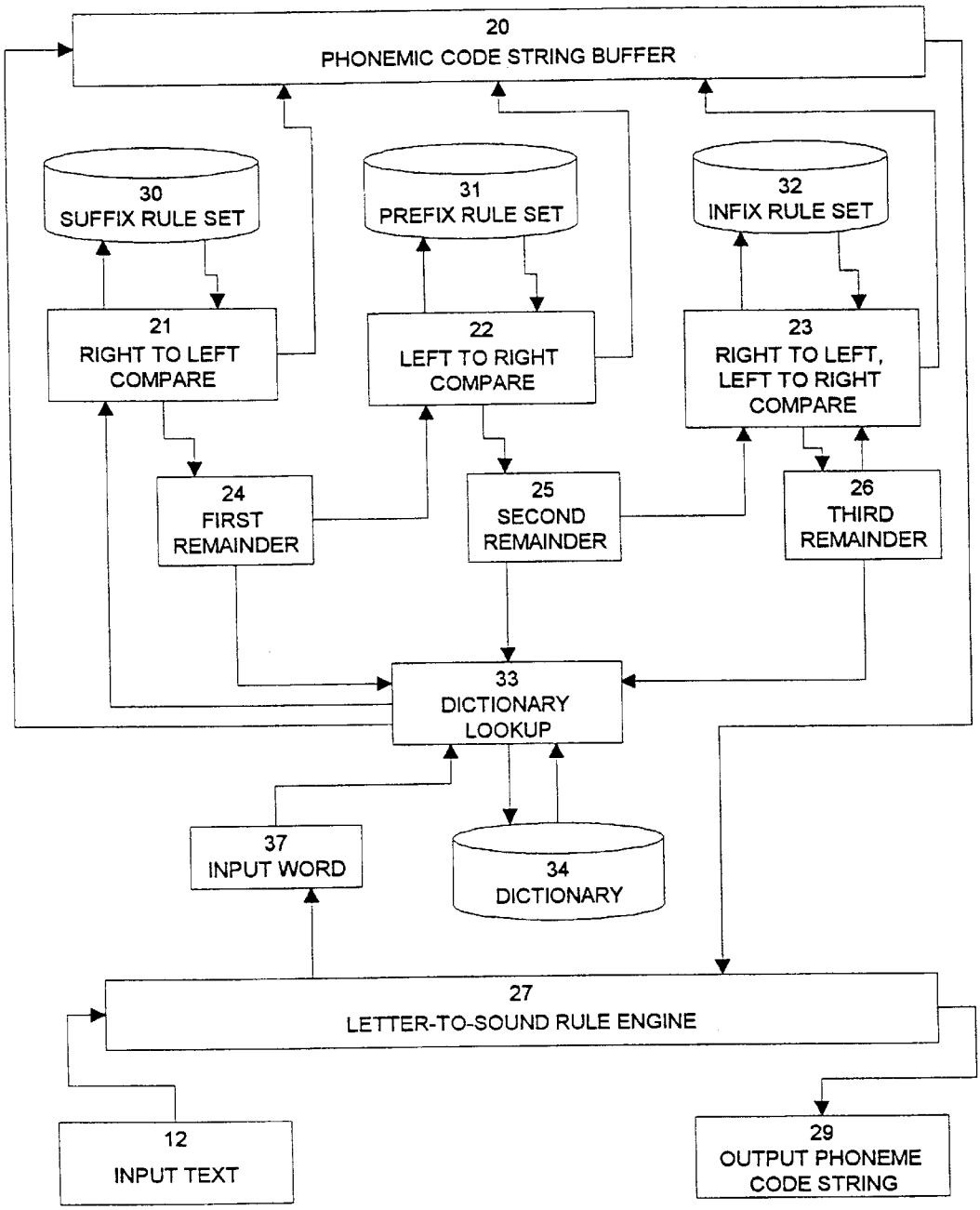
FIG. 5 illustrates data flow and processing components of another embodiment of the letter-to-sound processor which uses a dictionary lookup function before and during rule processing.

Another embodiment of the invention is shown in FIG. 5. In this embodiment, as in the embodiment shown by FIG. 4, the rule processing compare functions 21, 22, 23 operate just as in previous embodiments. However, in this embodiment, the dictionary lookup function 33 is provided not only for the whole input word 37, but also for each of the first and second remainders 24 and 25, output from the respective compare functions 21, 22. As the compare functions 21, 22 complete processing, the first and second remainders 24 and 25 are examined by the dictionary lookup function 33 against the dictionary 34, to determine if the remainder text has a corresponding entry in the dictionary 34. If the remainder text appears in the dictionary 34, the phonemic data for this text is extracted from the corresponding dictionary entry and placed into the appropriate position within phonemic code string buffer 20. The dictionary lookup function 33 then signals the LTS rule engine 27 that the input word 37 has been completely converted to phonemic data (via the dictionary lookup process). That is, if the dictionary lookup succeeds on either the first or second remainder 24, 25, then there is no need to continue compare function processing. As in former embodiments, the LTS rule engine 27 may thus proceed to return the output phoneme code string 29 and begin processing the next input word 37.

Note in FIG. 5, that the right-to-left, left-to-right compare function 23 outputs a third remainder 26. The third remainder 26 is actually the text remaining at step 68, of the processing shown in FIG. 6, for the right-to-left, left-to-right compare function 23. That is, in this embodiment, after an infix rule matches text within the second remainder 25, any remaining text may be used as text for the dictionary lookup function 33.

In yet another alternative embodiment, the dictionary lookup function 33 may be called between steps 67 and 68 of the processing of FIG. 6, for each of the compare functions 21, 22, 23. Each time a substring is removed from the text in step 67 of FIG. 6, the dictionary lookup function 33 may determine if the remaining text exists as an entry in the dictionary. The dictionary lookup function 33 may be performed in parallel with the continued processing of the steps in FIG. 6. Thus, as each rule matches substrings of text and the substrings are removed, the dictionary lookup function 33 attempts to match any remaining text to dictionary entries. Any time the dictionary lookup function 33 detects a match in dictionary 34, the phonemic data representing the entire remaining text after step 67 in FIG. 6 may be placed into the appropriate portion of the phonemic code string buffer 20. The LTS rule engine 27 is then signaled to return the output phoneme code string 29 and process the next input word 37, as previously described.

It is not necessary to have a single dictionary in the aforementioned dictionary lookup embodiments of the invention. Instead, there may be more than one dictionary accessed by the dictionary lookup function 33, depending upon which portion (i.e., which remainder 24, 25, 26) of the word is being looked up in the dictionary. For instance, an input word dictionary may be exemplified such that it only contains entries for whole input words 37 and their corresponding phonemic data. By having a separate input word dictionary, dictionary entries that only match remainder letter strings need not be searched when looking for an entire input word in the input word dictionary.

As previously noted, the purpose of the dictionary is to speed up text-to-speech processing of words which have letter groups that may be difficult to convert to phonemes via rule processing. There may be separate remainder dictionaries as well. For example, there may be a first remainder dictionary that only contains dictionary entries tailored for letter groups containing no suffix-like portions. Since the first remainder 24 is output from the right-to-left compare function 21 in FIG. 5, there will be no ending text substrings remaining in the first remainder 24. The first remainder dictionary may thus contain portions of words, absent any ending strings. There may also be separate dictionaries for the second and third remainders as well. Having separate dictionaries saves processing time by examining only entries that are relevant for particular remaining portions of text strings.

As explained in each of the embodiments shown in FIGS. 3, 4 and 5, and in their variations as noted above, three rule sets 30, 31, 32 are used. In each of these embodiments, grapheme substrings of an input word 37 from the input text 12 are compared first with the suffix rule set 30, then with the prefix rule set 31, and then with the infix rule set 32. Substrings are selected from different positions within the input word, depending upon which specific rule set (suffix, prefix or infix) the substrings are being compared to. In an alternative embodiment to each of the aforementioned embodiments, the order of rule set processing may be varied.

For example, in another alternative embodiment of the invention, the order of rule set processing for the suffix and prefix rule sets may be reversed. In these alternative embodiments, first the prefix rule set 31 is processed, then the suffix rule set 30, and finally the infix rule set 32. Pictorially, in each of the embodiments shown in FIGS. 3, 4 and 5, the left-to-right compare function 22 together with the prefix rule set 31, would be switched with the right-to-left compare function 21 and the suffix rule set 30, respectively.

In yet another alternative embodiment to each of the aforementioned embodiments, the rule processing for the prefix and suffix rule sets 31, 30 may be done in parallel. In such an embodiment, both the right-to-left compare function 21 and the left-to-right compare functions 22 are performed simultaneously, with each function operating on the initial input word 37. After each compare function 21 and 22 completes processing in parallel, any remaining text is passed to the right-to-left, left-to-right compare function 23. The function 23 proceeds as described previously.

Such an embodiment, where the ending and beginning portions of an input word 37 are processed in parallel, is mentioned herein for thoroughness, and is useful for long text strings. However, problems may occur with processing overlap in this specific embodiment. In such problem cases, each of the suffix and prefix compare functions 21, 22, being processed in parallel, may end up matching a portion of a substring of the input word 37 that has already been matched by the other compare process taking place in parallel. However, with a useful rule set that has been created using efficient rules, this is not likely to occur. In the event that it does occur, one process would have priority over the other for the characters that matched both processes.

Figure 7:
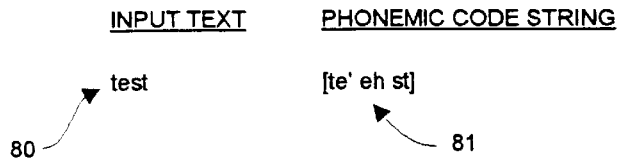
FIG. 7 illustrates the relationship between an example word and its phonemic data.

An example walk through of the processing steps of the invention will now be presented to aid in understanding the invention. For reference, FIG. 7 shows the relationship between a word of input text 80 and its corresponding phonemic code string 81, shown as pronunciation characters. As shown in FIG. 7, the word "test" gets converted to "te' eh st", much the same way as a dictionary provides the phonetical representation of a word.

Figure 8:
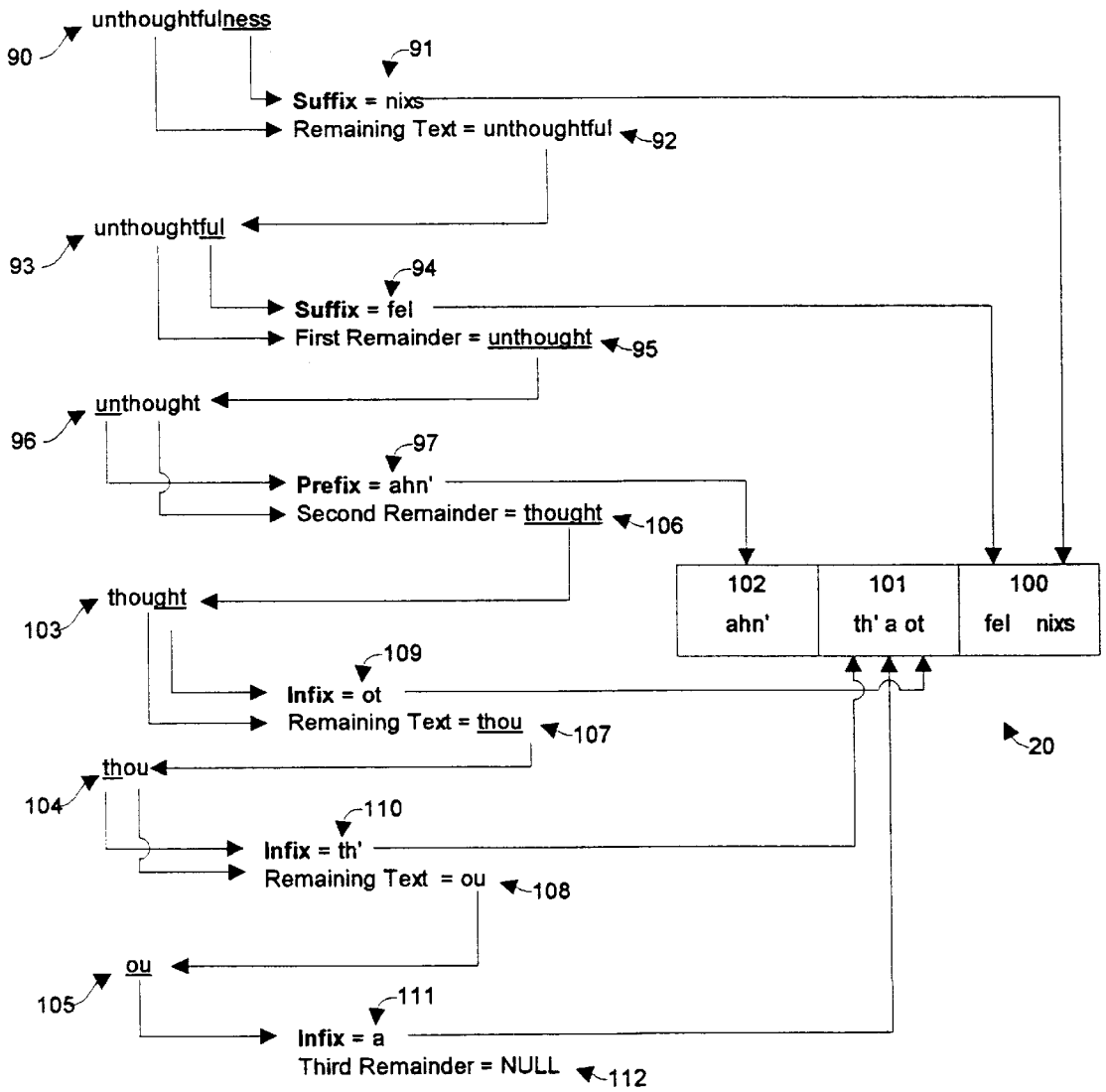
FIG. 8 illustrates the conversion of an example word to its phonemic data according to the processing steps of the present invention in the FIG. 3 embodiment.

For the example, the word "unthoughtfulness" will be processed, as illustrated in FIG. 8. The word "unthoughtfulness", shown at 90 in FIG. 8, is selected as an example word due to its complexity. For this example, assume the entire input text 12 is the single word "unthoughtfulness", as shown at 90 in FIG. 8.

The LTS rule engine 27 begins by passing the input word "unthoughtfulness", into the right-to-left compare function 21. Assume for this example that the longest grapheme string in any rule set is four characters in length. After a certain number of iterations of steps 62 through 65 in FIG. 6, the ending text string "ness" (underlined in 90 in FIG. 8) matches, at step 63, a "ness" grapheme string and conditions of a rule in suffix rule set 30. The corresponding phonemic data "nixs" 91 is then entered, via step 66, into the ending portion 100 of the phonemic code string buffer 20. Step 67 removes "ness" from the input text and step 68 detects "unthoughtful" as the remaining text 92.

Step 61 then re-selects the first rule (i.e., the top order rule applying to a text string no longer than the remaining text 92) in the suffix rule set 30. Step 62 selects the current ending substring "tful" from the end of "unthoughtful" and begins the iteration of steps 62 through 65. Since no four character grapheme suffix rule exists for substring "tful", processing 21 comes to three character grapheme string suffix rules. As soon as the first occurrence of a three character grapheme string suffix rule appears, step 62 shortens the subject ending substring to "ful" (shown underlined at 93 in FIG. 8). Eventually, "ful" matches, in step 63 of FIG. 6, the suffix rule having the grapheme string "ful". Step 66 then enters the corresponding phonemic data "fel" 94 into the ending portion 100 of the phonemic code string buffer 20. After returning to step 61 with "unthought" 95 and again selecting the first rule in the suffix rule set 30, further iterations of steps 62 through 65 produce no suffix matches for any substrings at the end of "unthought". Step 65 eventually detects the last rule in the suffix rule set 30, and exits the processing of FIG. 6, via step 69. On output, "unthought" 95 is returned as the first remainder 24 in FIG. 3 (also as shown at 96 in FIG. 8).

The processing of FIG. 6 is then repeated on the first remainder text 96 "unthought", but for the left-to-right compare function 22. During processing of the left-to-right compare function 22, beginning text strings are selected from "unthought," such as the text string "un" (underlined at 96 in FIG. 8). Since "un" is the only beginning text string in "unthought" that matches any of the rules' grapheme strings in the prefix rule set 31, the corresponding phonemic data "ahn" 97 is entered into the prefix portion 102 of the phonemic code string buffer 20. Then "un" is removed from "unthought" to produce the second remainder 25 (of FIG. 3) "thought" at 106 in FIG. 8.

Second remainder 106 "thought" is then passed as input text string 103 into the right-to-left, left-to-right compare function 23 for comparison with infix rules. As shown in FIG. 8, each of the underlined intermediate substrings 103, 104, 105 is respectively selected from either end of the remaining text strings 106–108, and matched to grapheme strings of respective rules in the infix rule set 32. Each infix substring is converted to its corresponding respective phonemic data 109–111 and stored in the intermediate portion 101 of the phonemic code string buffer 20. At each iteration of steps 61–68 of FIG. 6, for the right-to-left, left-to-right compare function 23, the remaining text 106–108 gets shorter and shorter. When the processing is complete, as shown in FIG. 8, the third remainder 112 is NULL, with no remaining text. The beginning 102, intermediate 101 and ending 100 portions of the phonemic code string buffer 20 together provide the entire phonemic representation of the input word 90 "unthoughtfulness".

As briefly noted earlier, the embodiments of the invention may be implemented on a computer data processing system such as that shown in FIG. 1. In FIG. 1, the computer system 06 comprises intercoupled components 01–05.

The computer system 06 generally includes an interconnection mechanism 05 coupling an input device 01, a processor 02, a storage device 03 and an output device 04. The input device 01 receives data in the form of commands, computer programs or data files such as text files and other information as input to the computer system 06 from users or other input sources. Typical examples of input devices include a keyboard, a mouse, data sensors, and a network interface connected to a network to receive another computer system's output.

The interconnection mechanism 05 allows data and processing control signals to be exchanged between the various components 01–04 of the computer system 06. Common examples of an interconnection mechanism are a data bus, circuitry, and in the case of a distributed computer system, a network or communication link between each of the components 01–04 of computer system 06.

The storage device 03 stores data such as text to be synthesized into speech and executable computer programs for access by the computer system 06. Typical storage devices may include computer memory and non-volatile memory such as hard disks, optical disks, or file servers locally attached to the computer system 06 or accessible over a computer network.

The processor 02 executes computer programs loaded into the computer system 06 from the input or storage devices. Typical examples of processors are Intel's Pentium, Pentium II, and the 80×86 series of microprocessors; Sun Microsystems's SPARC series of workstation processors; as well as dedicated application specific integrated circuits (ASIC's) or digital signal processors (DSP's) such as the TMS320 series DSP processor from Texas Instruments, Inc. The processor 02 may also be any other microprocessor commonly used in computers for performing information processing.

The output device 04 is used to output information from the computer system 06. Typical output devices may be computer monitors, LCD screens or printers, speakers or recording devices, or network connections linking the computer system 06 to other computers. Computer systems such as that shown in FIG. 1 commonly have multiple input, output and storage devices as well as multiple processors.

Generally, in operation, the computer system 06 shown in FIG. 1 is controlled by an operating system. Typical examples of operating systems are MS-DOS and Windows95 from Microsoft Corporation, or Solaris and SunOS from Sun Microsystems, Inc., as well as SPOX from Innovative Integration, Inc., or a custom kernel operating system. As the computer system 06 operates, input such as text data, text file or Web page data, programs and commands, received from users or other processing systems, are temporarily stored on storage device 03. Certain commands cause the processor 02 to retrieve and execute the stored programs.

The programs executing on the processor 02 may obtain more data from the same or a different input device, such as a network connection. The programs may also access data in a database or file for example, and commands and other input data may cause the processor 02 to begin speech synthesis and perform other operations on the text in relation to other input data. Voice signal data may be generated which is sent to the output device 04 to be "spoken" to the user or for transmission to another computer system or device for further processing. Typical examples of the computer system 06 are personal computers and workstations, hand-held computers, dedicated computers designed for a specific speech synthesis purposes, and large main frame computers suited for use by many users. The invention is not limited to being implemented on any specific type of computer system or data processing device.

It is noted that the invention may also be implemented in hardware or circuitry which embodies the logic and speech processing disclosed herein, or alternatively, the invention may be implemented in software in the form of a computer speech synthesizer, or other type of program stored on a computer readable medium, such as the storage device 03 shown in FIG. 1. In the later case, the invention in the form of computer program logic and executable instructions is read and executed by the processor 02 and instructs the computer system 06 to perform the functionality disclosed as the invention herein.

If the invention is embodied as a computer program, the computer program logic is not limited to being implemented in any specific programming language. For example, commonly used programming languages such as C, C++, and JAVA, as well as others may be used to implement the logic and functionality of the invention. Furthermore, the subject matter of the invention is not limited to currently existing computer processing devices or programming languages, but rather, is meant to be able to be implemented in many different types of environments in both hardware and software.

Furthermore, combinations of embodiments of the invention may be divided into specific functions and implemented on different individual computer processing devices and systems which may be interconnected to communicate and interact with each other. Dividing up the functionality of the invention between several different computers is meant to be covered within the scope of the invention.

As previously noted, the operational steps shown in FIG. 6 are general in nature, and describe the operation of rule set compare processing according to one embodiment of the invention. It is to be understood that the processing steps shown in FIG. 6 may be re-arranged by one skilled in the art, while still maintaining the overall functionality of the invention. For example, instead of selecting a text substring in step 62 each time a new rule is selected in step 64, the invention may employ a mechanism to detect when the grapheme of the new rule changes length (i.e., gets shorter) with respect to the previous rule's grapheme. A new substring then may be selected at that point in processing, thus reducing the frequency of execution of step 62 at each iteration of the loop of steps 62–65. This is but one example variation that may be apparent to those skilled in the art. The present invention is intended to cover the various alternative ways to re-arrange the steps in FIG. 6 as well as the general nature of processing disclosed in FIG. 6, while still being within the scope of the invention. As such the invention is not at all limited to the exact order of the processing steps shown by FIG. 6.

It should also be understood that the particular format of the rules and rule sets described in relation to this invention is not limited to those formats disclosed herein. Rather, it should now be evident, in light of this invention, that there are many ways of encoding individual rules to map grapheme strings to phonemic data. The examples given herein are merely illustrative and are presented to convey the principles of the invention to the reader.

Moreover, rule sets may be stored in many various ways other than just in files. For example, a rule set may be stored in a database system for access to clients performing text-to-speech translation. There may be rules for many different languages and depending upon the language which the text is based in, the appropriate rule sets may be selected from the database. The organizational arrangement of rules in rule sets (i.e., largest to smallest) is also not meant to be limiting. For example, an un-ordered rule set may also be used by the invention such that each time step 61 in FIG. 6 is performed, the first rule in the set is selected. These and other variations are meant to be within the scope of the invention.

While this invention has been particularly shown and described with references to various embodiments thereof, it will be understood by those skilled in the art that various changes in form and details may be made without departing from the spirit and scope of the invention as defined by the following claims.

For example, the different rule sets are described above as being formed of a plurality of ordered rules. The illustrated ordering is by length of the character string to be matched and, within same length strings, alphabetically or some sortable order. The predefined sortable order may be language dependant, or some other mechanics or a combination. Likewise the ordering throughout a given rule set may be by other combinations in addition to or in place of the length and alphabetic ordering of the illustrated preferred embodiment. Such is in the purview of one skilled in the art given the foregoing description.

What is claimed is:

1. In a digital processing system, a method for creating phonemic data from text, comprising the steps of:

receiving input text;

providing a plurality of rule sets, one rule set for processing one portion of the input text and different rule sets for processing respective different portions of the input text, each rule set having one or more rules for processing a respective portion of the input text;

for each rule set, iteratively applying the rules of the rule set to the input text by comparing the input text with at least one of the rules of the rule set to produce respective phonemic data portions corresponding to portions of the input text, different rule sets producing different phonemic data portions; and combining the produced phonemic data portions to form a phonemic data sequence corresponding to the input text.

2. The method of claim 1, wherein:

the plurality of rule sets includes a suffix rule set having a multiplicity of suffix rules, and wherein the applying step iteratively compares the input text with the suffix rules in the suffix rule set to produce ending portions of the phonemic data sequence; and wherein a remainder of the input text is compared with a remainder of the plurality of rule sets to produce a remainder portion of the phonemic data sequence.

3. The method of claim 2 wherein in the applying step, suffix rules are compared with the input text beginning at a rightmost part of the input text and the comparison with each suffix rule is performed in a right to left direction with respect to the input text.

4. The method of claim 2 further comprising the step of performing a dictionary lookup on the remainder of the input text after the input text has been iteratively compared with the suffix rules.

5. The method of claim 1, wherein:

the plurality of rule sets includes a prefix rule set having multiple prefix rules, and wherein the applying step iteratively compares the input text with prefix rules in the prefix rule set to produce beginning portions of the phonemic data sequence; and wherein a remainder of the input text is compared with a remainder of the plurality of rule sets to produce a remainder portion of the phonemic data sequence.

6. The method of claim 5 wherein in the applying step, prefix rules are compared with the input text beginning at a leftmost part of the input text and the comparison with each prefix rule is performed in a left to right direction with respect to the input text.

7. The method of claim 5 further comprising the step of performing a dictionary lookup on the remainder of the input text after the text input has been compared with the prefix rules.

8. The method of claim 1, wherein:

the plurality of rule sets includes an infix rule set having a multiplicity of infix rules, and wherein the applying step iteratively compares the input text with infix rules in the infix rule set to produce middle portions of the phonemic data sequence; and wherein a remainder of the input text is compared with a remainder of the plurality of rule sets to produce a remainder portion of the phonemic data sequence.

9. The method of claim 8 wherein in the applying step, infix rules are compared with the input text beginning at a rightmost part of the input text and the comparison with each infix rule is performed in a right to left direction with respect to the input text, and wherein infix rules are compared with the input text beginning at a leftmost part of the input text and the comparison with each infix rule is performed in a left to right direction with respect to the input text.

10. The method of claim 8 further comprising the step of performing a dictionary lookup on the remainder part of the input text after the input text has been compared with the infix rules.

11. The method of claim 1 further comprising the step of:

performing a dictionary lookup on the input text after the receiving input text step.

12. The method of claim 1, wherein the step of providing a plurality of rule sets includes providing a suffix rule set, a prefix rule set and an infix rule set, the suffix rule set having text-to-phonemic data rules for ending portions of input text, the prefix rule set having text-to-phonemic data rules for beginning portions of the input text, and the infix rule set having text-to-phonemic data rules for intermediate portions of the input text; and wherein the step of applying the rules further comprises the steps of:

iteratively comparing the input text to the rules in the suffix rule set to ultimately produce phonemic data ending portions based on ending portions of the input text and to produce a first remainder text excluding the ending portions of the input text;

iteratively comparing the first remainder text to the rules in the prefix rule set to produce phonemic data beginning portions based on beginning portions of the first remainder text and to ultimately produce a second remainder text excluding the beginning portions of the first remainder text;

iteratively comparing the second remainder text to the rules in the infix rule set to produce phonemic data middle portions based on intermediate portions of the input text; and such that the step of combining combines the phonemic data beginning portions, the phonemic data middle portions and the phonemic data ending portions to produce the phonemic data sequence which phonetically represents the input text.

13. The method of claim 12, wherein the step of comparing the input text to the rules in the suffix rule set compares the input text beginning at a rightmost part of the input text and compares in a right to left direction, with respect to the input text, against each rule of the suffix rule set.

14. The method of claim 13, wherein the step of comparing the first remainder text to the rules in the prefix rule set compares the first remainder text beginning at a leftmost part of the first remainder text and compares in a left to right direction, with respect to the first remainder text, against each rule of the prefix rule set.

15. The method of claim 14, wherein the step of comparing the second remainder text to the rules in the infix rule set compares the second remainder text with each rule of the infix rule set beginning from a rightmost part of the second remainder text and compares in a right to left direction to obtain the phonemic data middle portions, and compares the second remainder text with each rule of the infix rule set beginning from a leftmost part of the second remainder text and compares in a left to right direction to obtain the phonemic data middle portions, wherein the right to left and left to right comparisons are performed in parallel.

16. The method of claim 15, wherein:

the step of providing a plurality of rule sets further includes, for each of the rule sets, arranging the rules of the rule set in order according to length of text to which the rule applies, from largest in length to smallest in length, and arranging in a predefined order the rules applying to equivalent lengths of text; and wherein each comparing step compares one of input text and remainder text against a respective rule set beginning with a rule of the rule set that applies to a largest length of text encompassed by length of the input text or remainder text being compared.

17. The method of claim 13, wherein the step of comparing the second remainder text to the infix rule set compares the second remainder text with each rule of the infix rule set beginning from a rightmost part of the second remainder text and compares in a right to left direction to obtain the phonemic data middle portions, and compares the second remainder text with each rule of the infix rule set beginning from a leftmost part of the second remainder text and compares in a left to right direction to obtain the phonemic data middle portions, wherein the right to left and left to right comparisons are performed in parallel.

18. The method of claim 12, wherein the step of comparing the first remainder text to the prefix rule set compares the first remainder text beginning at a leftmost part of the first remainder text and compares in a left to right direction, with respect to the first remainder text, against each rule of the prefix rule set.

19. The method of claim 18, wherein the step of comparing the second remainder text to the infix rule set compares the second remainder text with each rule of the infix rule set beginning from a rightmost part of the second remainder text and compares in a right to left direction to obtain the phonemic data middle portions, and compares the second remainder text with each rule of the infix rule set beginning from a leftmost part of the second remainder and compares in a left to right direction to obtain the phonemic data middle portions, wherein the right to left and left to right comparisons are performed in parallel.

20. The method of claim 12, wherein the step of comparing the second remainder text to the infix rule set compares the second remainder text with each rule of the infix rule set beginning from a rightmost part of the second remainder text and compares in a right to left direction to obtain the phonemic data middle portions, and compares the second remainder text with each rule of the infix rule set beginning from a leftmost part of the second remainder text and compares in a left to right direction to obtain the phonemic data middle portions, wherein the right to left and left to right comparisons are performed in parallel.

21. The method of claim 12, wherein:

the step of providing a plurality of rule sets further includes, for each of the rule sets, arranging the rules of the rule set in order according to length of text to which the rule applies from largest in length to smallest in length, and arranging in a predefined order the rules applying to equivalent lengths of text; and wherein each comparing step compares one of input text and remainder text against a respective rule set beginning with a rule of the rule set that applies to a largest length of text encompassed by length of the input text or remainder text being compared.

22. The method of claim 1, wherein:

the step of providing a plurality of rule sets includes, for each of the rule sets, arranging the rules of a rule set in order according to length of text which the rule applies from largest in length to smallest in length, and arranging in alphabetical order the rules applying to equivalent lengths of text; and wherein the step of applying the rules of a respective rule set includes comparing the input text against the rule set beginning with a rule of the rule set that applies to a largest length of text encompassed by length of the input text.

23. A method of translating an incoming text string to corresponding phonemic data representing the input text string for use in a speech synthesizer, comprising the steps of:

in a computer medium, providing a suffix rule set, a prefix rule set and an infix rule set, each rule set having a respective plurality of rules for specifying phonemes for respective text strings;

in a digital processor, comparing substrings of an incoming text string to rules of the suffix rule set and when a match is found, placing phonemes specified by a matching rule into a work storage area and modifying the incoming text string by effectively removing from the incoming text string the substring of the incoming text string which matched the rule in the suffix rule set, such that a modified incoming text string is formed;

for each time the incoming text string is modified, repeating the comparing step with the modified incoming text string as last modified and the suffix rule set until there are no more matches for the suffix rule set in the modified incoming text string as last modified;

comparing substrings of the incoming text string to rules of the prefix rule set and when a match is found, placing phonemes specified by a matching rule into the work storage area and modifying the incoming text string by effectively removing from the incoming text string the substring of the incoming text string which matched the rule in the prefix rule set such that a modified incoming text string is formed;

for each time the incoming text string is modified, repeating the comparing step with the modified incoming text string as last modified and the prefix rule set until there are no more matches for the prefix rule set in the modified incoming text string as last modified;

comparing substrings of the incoming text string to rules of the infix rule set and when a match is found comparing substrings of the incoming text string to rules of the infix rule set and when a match is found, placing phonemes specified by a matching rule into the work storage area and modifying the incoming text string by effectively removing from the incoming text string the substring of the incoming text string which matched the rule in the infix rule set such that a modified incoming text string is formed;

for each time the incoming text string is modified, repeating the comparing step with the modified incoming text string as last modified and the infix rule set until there are no more matches for the infix rule set in the modified incoming text string as last modified;

until each substring of the incoming text string has a corresponding phonemes stored in the work storage area, such that a phonemic data sequence representing the incoming text string is formed and held in the work storage area for use in a speech synthesizer.

24. The method of claim 23, wherein:

the steps of comparing substrings of the incoming text string to rules of the suffix rule set and repeating the comparing step with respect to the suffix rule set forms a first pair of steps;

the steps of comparing substrings of the incoming text string to rules of the prefix rule set and repeating the comparing step with respect to the prefix rule set forms a second pair of steps;

the steps of comparing substrings of the incoming text string to rules of the infix rule set and repeating the comparing step with respect to the infix rule set forms a third pair of steps; and the digital processor further performs the first, second and third pairs of steps in one of:

(a) first, second, third pair order;
(b) second, first, third pair order;
(c) first, third, second pair order;
(d) second, third, first pair order;
(e) third, first, second pair order; and
(f) third, second, first pair order.

25. The method of claim 23, wherein:

the step of comparing substrings to rules of the suffix rule set includes beginning comparing substrings at an ending portion of the incoming text string, and comparing substrings in an end to beginning direction of the substring;

the step of comparing substrings to rules of the prefix rule set includes beginning comparing substrings at a beginning portion of the incoming text string, and comparing substrings in a beginning to end direction of the substring; and the step of comparing substrings to rules of the infix rule set includes comparing substrings at a beginning portion of the incoming text string and comparing substrings in a beginning to end direction of the substring, and comparing substrings at an end portion of the incoming text string and compares substrings in an end to beginning direction of the substring.

26. The method of claim 25, further including the step of employing a dictionary look up of at least one of the incoming text string and modified incoming text string as last modified.

27. In a data processing system having a digital processor, an apparatus for translating incoming text to phoneme data, the apparatus comprising:

a source of incoming text;

a letter-to-sound processor executable by the digital processor and coupled to receive incoming text from the source, the letter-to-sound processor including a rule engine and a plurality of rule sets, each rule set including rules encoding translation of portions of incoming text to corresponding portions of phoneme data for representing the incoming text;

an input device for obtaining the incoming text;

in response to the letter-to-sound processor receiving the incoming text, the rule engine comparing portions of the incoming text to the rules in each of the plurality of rule sets, for different portions of the incoming text the rule engine comparing to different rule sets depending on location of the portion in the incoming text, and upon the rule engine determining a match between a rule and a subject portion of the incoming text, the rule engine producing a corresponding portion of the phoneme data according to the rule that was matched, such that the letter-to-sound processor combines the portions of the phoneme data and on output, provides the phoneme data representing the incoming text.

28. The apparatus of claim 27 wherein:

the plurality of rule sets includes a suffix rule set, a prefix rule set, and an infix rule set;

the rule engine first comparing ending portions of the incoming text to rules of the suffix rule set to produce ending portions of the phoneme data and a first remainder portion of the incoming text;

the rule engine comparing the first remainder portion of the incoming text with rules of the prefix rule set to produce beginning portions of the phoneme data and a second remainder portion of the incoming text; and the rule engine further comparing the second remainder portion of the incoming text to rules of the infix rule set to produce intermediate portions of the phoneme data.

29. The apparatus of claim 28 further comprising:

a dictionary coupled to the letter-to-sound processor formed of a multiplicity of entries, each entry cross referencing a respective text string to a corresponding phoneme data string for representing the text string;

the letter-to-sound processor using the dictionary to perform a dictionary lookup on at least one of the incoming text, the first remainder portion and the second remainder portion to produce the phoneme data representing the incoming text.

30. The apparatus of claim 29, wherein:

the rule engine iteratively compares each rule of the suffix rule set beginning at a rightmost position in the ending portions of the incoming text and compares the rules in a right to left direction with respect to the incoming text;

the rule engine iteratively compares the rules from the prefix rule set beginning at a leftmost position in the first remainder portion of the incoming text and compares the rules in a left to right direction with respect to the first remainder portion of the incoming text; and the rule engine iteratively compares each rule of the infix rule set beginning at a rightmost position of the second remainder portion such that the comparison of the second remainder portion with the rules of the infix rule set is in a right to left direction with respect to the incoming text, and the rule engine compares the rules of the infix rule set against the second remainder portion beginning at a leftmost position of the second remainder portion such that the comparison of the second remainder portion with the rules in the infix rule set is in a left to right direction with respect to the second remainder portion of the incoming text.

31. The apparatus as claimed in claim 28 wherein:

the rule engine compares each rule of the suffix rule set beginning at a rightmost position in the ending portions of the incoming text and compares the rules in a right to left direction with respect to the incoming text;

the rule engine compares the rules from the prefix rule set beginning at a leftmost position in the first remainder portion of the incoming text and compares the rules in a left to right direction with respect to the first remainder portion of the incoming text; and the rule engine compares each rule of the infix rule set beginning at a rightmost position of the second remainder portion such that the comparison of the second remainder portion with the rules of the infix rule set is in a right to left direction with respect to the incoming text, and the rule engine compares the rules of the infix rule set against the second remainder portion beginning at a leftmost position of the second remainder portion such that the comparison of the second remainder portion with the rules in the infix rule set is in a left to right direction with respect to the second remainder portion of the incoming text.

32. The apparatus as claimed in claim 31 wherein:

in each of the suffix rule set, prefix rule set and infix rule set, the respective rules are arranged in order according to length of text to which the rule applies, from longest in length to shortest in length, and in a predefined order for rules applying to a same length text; and the rule engine comparing one of the ending portions of the incoming text, the first remainder portion and the second remainder portion against a respective rule set beginning with a rule of the rule set that applies to a longest length of text encompassed by length of the portion of incoming text being compared.

33. The apparatus as claimed in claim 28 wherein:

in each of the suffix rule set, prefix rule set and infix rule set, the respective rules are arranged in order according to length of text to which the rule applies, from longest in length to shortest in length, and in a predefined order for rules applying to a same length text; and the rule engine comparing one of the ending portions of the incoming text, the first remainder portion and the second remainder portion against a respective rule set beginning with a rule of the rule set that applies to a longest length of text encompassed by length of the portion of incoming text being compared.

34. The apparatus as claimed in claim 27 wherein:

in each of the rule sets, the respective rules are arranged in order according to length of text to which the rule applies, from longest in length to shortest in length, and in alphabetical order for rules applying to a same length text;

the rule engine comparing one of the ending portions of the incoming text, the first remainder portion and the second remainder portion against a respective rule set beginning with a rule of the rule set that applies to a longest length of text encompassed by length of the portion of incoming text being compared; and the rule engine comparing portions of the incoming text against a respective rule set beginning with a rule of the rule set that applies to a longest length of text encompasses by length of the portion of incoming text being compared.

35. The apparatus of claim 27, wherein:

the data processing system is incorporated into a navigation system, the navigation system including an output sound system coupled to receive phoneme data from the letter-to-sound processor, the output sound system translating the phoneme data to sound signals and providing a spoken characterization of the incoming text in an audible fashion.

36. The apparatus as claimed in claim 27, wherein the letter-to-sound processor is incorporated into a speech synthesizer used to translate text to speech.

37. The apparatus as claimed in claim 28, wherein during the rule engine comparing the second remainder portion of the incoming text to rules of the infix rule set to produce intermediate portions of the phoneme data, the rule engine avoids splitting the second remainder into multiple third remainders by first detecting and delimiting a largest group of infix rule matching characters existing within the second remainder portion of the incoming text to create at least one third remainder, and comparing the at least one third remainder to rules of the infix rule set to produce intermediate portions of the phoneme data before comparing the largest group of infix rule matching characters to produce phoneme data.

38. The method of claim 12, wherein before performing the step of iteratively comparing the second remainder text to rules in the infix rule set to produce phonemic data middle portions, the method performs the steps of:

detecting and delimiting a largest group of infix rule matching characters existing within the second remainder text to create at least one third remainder; and comparing the at least one third remainder to rules of the infix rule set to produce phonemic data middle portions before comparing the largest group of infix rule matching characters to produce phonemic data middle portions, to avoid splitting the second remainder portion into multiple third remainders.

* * * * *